United States Patent [19]

Phillips

[11] 3,977,095

[45] Aug. 31, 1976

[54] BREAK-AWAY HEEL FOR SHOES

[76] Inventor: Esther M. Phillips, 1336 Straight Path, Wyandanch, L. I., N.Y. 11798

[22] Filed: Sept. 26, 1975

[21] Appl. No.: 617,196

[52] U.S. Cl. ..... 36/42

[51] Int. Cl.[2] ..... A43B 21/36

[58] Field of Search ..... 36/42, 41, 36 R, 34 R, 36/34 A

[56] References Cited

UNITED STATES PATENTS

| | | | |
|---|---|---|---|
| 2,707,341 | 5/1955 | Romano | 36/34 R |
| 2,767,489 | 10/1956 | Sturman | 36/34 R |
| 3,063,170 | 11/1962 | Purtell | 36/42 |
| 3,074,187 | 1/1963 | Klein | 36/42 |
| 3,305,948 | 2/1967 | Ronci | 36/34 A |

*Primary Examiner*—Alfred R. Guest

[57] ABSTRACT

This heel consists primarily of a magnetic spool which is imbedded within the heel of a woman's shoe, the magnetic spool serving to removably receive an extending magnetic rod of a heel extension which may be carried in one's purse when not in use.

3 Claims, 3 Drawing Figures

BREAK-AWAY HEEL FOR SHOES

This invention relates to foot wear, and more particularly to a break-away heel for shoes.

It is therefore the principal object of this invention to provide a break-away heel for shoes which will enable the user to instantly, have a higher heel on shoes when desired.

Another object of this invention is to provide a break-away heel which will utilize magnetic force to retain the heel extension on a shoe.

A further object of this invention is to provide a heel of the type described, which will consist of a magnetic spool which will be securely imbedded within the fixed heel of a shoe, the magnetic spool being of such construction, so as to removably receive an extending magnetic rod of the heel extension.

A still further object of this invention is to provide a heel of the type described, which may be instantly separated when desired.

Other objects of the invention are to provide a break-away heel for shoes, which is simple in design, inexpensive to manufacture, rugged in construction, easy to use and efficient in use.

These and other objects will be readily evident upon a study of the following specification and the accompanying drawing, wherein.

Figure 1:
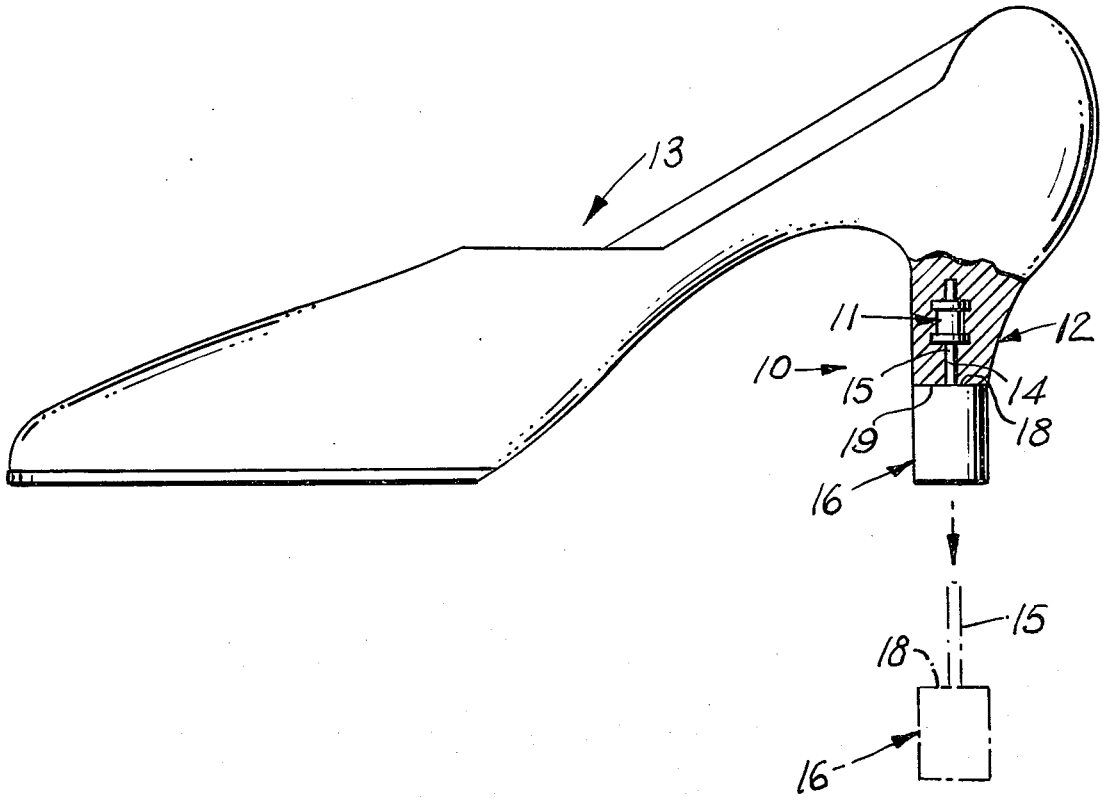
FIG. 1 is a side view of a shoe which is shown in elevation and partly broken away, the heel extension being shown in phantom lines to illustrate its removal.
Figure 2:
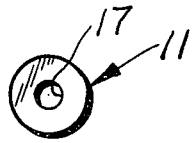
FIG. 2 is an enlarged plan view of the magnetic spool, shown removed from FIG. 1.
Figure 3:
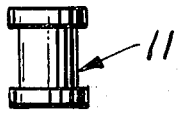
FIG. 3 is a vertical view of FIG. 2, shown in elevation.

According to this invention, a break-away heel 10 is shown to include a magnetic spool 11 which is fixedly imbedded within heel 12 of shoe 13. An opening 14 within heel 12 freely and slideably receives magnetic rod 15 which extends from and is imbedded fixedly within heel extension 16.

Opening 14 is in longitudinal alignment with opening 17 of spool 11, so as to enable magnetic rod 15 of extension 16, to be removably received and held fast, by magnetic force.

When extension 16 is applied to shoe 13, the top surface 18 of heel extension 16, abuts with surface 19 of heel 12.

What I claim is:

1. A break-away heel for shoes, comprising a heel fixedly secured to a shoe, magnetic spool means secured within said heel, a removable heel extension magnetically received on said heel of said shoe.

2. The combination according to Claim 1, wherein said magnetic spool is fixedly secured within the heel fixedly secured to said shoe and the longitudinal opening through said magnetic spool aligns along longitudinal axis of an opening within said heel fixedly secured to said shoe.

3. The combination according to Claim 2, wherein said opening through said heel of said shoe will removably receive said magnetic means of said heel extension, said magnetic means of said heel extension, comprising an extending magnetic rod which is fixedly secured within said heel extension from which said magnetic rod protrudes, abuts with the bottom surface of said heel, the magnetic sucks on said spool and said magnetic rod serving to render said heel extension, stationary to said heel secured fixedly to said shoe.

* * * * *